US009988240B2

(12) United States Patent
Anderson et al.

(10) Patent No.: US 9,988,240 B2
(45) Date of Patent: Jun. 5, 2018

(54) ELEVATOR WITH MASTER CONTROLLER

(71) Applicant: ThyssenKrupp Elevator AG, Essen (DE)

(72) Inventors: John Keith Anderson, Jackson, TN (US); Frank P. Dudde, Collierville, TN (US); Peter P. Feldhusen, Collierville, TN (US); Michael A. Palazzola, Horn Lake, MS (US); Jie Xu, Cordova, TN (US); Alan M. Parker, Byhalia, MS (US); William D. Delk, Olive Branch, MS (US); Olivia Stone, Memphis, TN (US)

(73) Assignees: ThyssenKrupp Elevator AG, Essen (DE); ThyssenKrupp AG, Essen (DE)

( * ) Notice: Subject to any disclaimer, the term of this patent is extended or adjusted under 35 U.S.C. 154(b) by 529 days.

(21) Appl. No.: 14/666,436

(22) Filed: Mar. 24, 2015

(65) Prior Publication Data

US 2016/0280511 A1 Sep. 29, 2016

(51) Int. Cl.

| | |
|---|---|
| ***B66B 1/34*** | (2006.01) |
| ***B66B 3/00*** | (2006.01) |
| ***B66B 5/18*** | (2006.01) |
| ***B66B 5/00*** | (2006.01) |
| ***B66B 5/04*** | (2006.01) |
| ***B66B 5/12*** | (2006.01) |
| ***B66B 1/32*** | (2006.01) |
| ***B66B 5/16*** | (2006.01) |

(52) U.S. Cl.

CPC ..... *B66B 5/18* (2013.01); *B66B 1/32* (2013.01); *B66B 5/0031* (2013.01); *B66B 5/04* (2013.01); *B66B 5/12* (2013.01); *B66B 5/16* (2013.01)

(58) Field of Classification Search

CPC ..... B66B 5/18; B66B 1/32; B66B 5/0031; B66B 5/04; B66B 5/12; B66B 5/16

USPC ..... 187/393

See application file for complete search history.

(56) References Cited

U.S. PATENT DOCUMENTS

| | | | | |
|---|---|---|---|---|
| 6,173,813 | B1 * | 1/2001 | Rebillard | B66B 5/06 187/287 |
| 6,802,395 | B1 * | 10/2004 | Helstrom | B66B 1/32 187/247 |
| 8,157,061 | B2 | 4/2012 | Gremaud et al. | |
| 2012/0000729 | A1 * | 1/2012 | Marvin | B66B 5/044 187/287 |
| 2012/0000731 | A1 * | 1/2012 | Schienda | B66B 5/06 187/305 |

(Continued)

FOREIGN PATENT DOCUMENTS

| | | | |
|---|---|---|---|
| EP | 2107029 | A1 | 10/2009 |

*Primary Examiner* — Jeffrey Donels

(74) *Attorney, Agent, or Firm* — Dinsmore & Shohl LLP

(57) ABSTRACT

A system and method for controlling the movement of an elevator is provided. The elevator controller directs the operation of the elevator and receives information from the elevator system to calculate a brake profile. The elevator system transmits the brake profile to a master controller. The master controller selectively actuates the brakes to apply a braking force configured to generate the brake profile. The system and method may include local controllers, each configured to actuate a respective brake, wherein the master controller selectively directs the local controllers to generate a brake force commensurate with the braking profile.

20 Claims, 6 Drawing Sheets

(56) References Cited

U.S. PATENT DOCUMENTS

| | | | | |
|---|---|---|---|---|
| 2012/0000732 | A1* | 1/2012 | Draper | B66B 5/06 187/373 |
| 2014/0311257 | A1* | 10/2014 | Hubbard | B66B 5/0037 73/862.12 |
| 2016/0101963 | A1* | 4/2016 | Nakari | B66B 1/36 187/254 |
| 2016/0221795 | A1* | 8/2016 | Dudde | B66B 5/18 |

* cited by examiner

ELEVATOR WITH MASTER CONTROLLER

FIELD OF THE INVENTION

An elevator system with a master controller configured to selectively control at least one of a plurality of brakes so as to provide a desired braking profile is provided.

BACKGROUND OF THE INVENTION

Current elevator systems include an elevator car that is controlled by an elevator controller. The elevator controller is in communication with a plurality of control panels, each of which is located on different floors of a building. The control panel includes inputs for selecting a desired floor of the building serviced by the elevator car. A signal corresponding to the selected floor is provided to the elevator controller and the elevator controller actuates the elevator drive so as to move the elevator car to the selected floor.

Current elevator systems are further configured to generate three braking profiles. One braking profile, referenced herein as an operational brake, is directed to stop the elevator car at a selected floor. Another braking profile is configured to stop the elevator car from an unintended movement, referenced herein as an unintended movement brake. As used herein, an unintended movement is the movement of the elevator car which was made without direction by the elevator controller. The third braking profile, referenced herein as a free fall brake, is configured to stop the elevator car from a free fall, which may occur if the cable is severed. The force characteristics of an unintended movement brake, free fall brake and operation brake are all different from each other. Currently, the elevator controller initiates all three braking profiles—the operational brake, unintended movement brake, and the free fall brake. The free fall brake may also be mechanically initiated, allowing the free-fall brake to operate independently from the elevator controller.

Currently, one braking system is configured to generate an unintended movement brake or an operational brake. Yet another braking system, independent of the previously mentioned braking system is configured to generate a free fall brake. Thus, it should be appreciated that the maintenance of one braking system requires the entire elevator to be shut down.

Currently, the actuation of the brake is binary, meaning the brakes are either actuated or are not. Thus, it should be appreciated that such binary systems may result in conditions of abrupt stopping or conditions where the elevator car is not level during braking.

Accordingly, it remains desirable to have an elevator system wherein all braking functions are controlled by one controller, and wherein braking forces may be distributed throughout all the braking systems so as to reduce down time for brake maintenance. It further remains desirable to have an elevator system wherein braking forces may be selectively actuated by one controller so as to prevent conditions of abrupt stopping and to provide a level elevator car during a stop.

SUMMARY OF THE INVENTION

An elevator system having a master controller configured to direct the braking system is provided. The elevator system includes an elevator controller configured to direct the operation of the elevator car. The elevator controller includes a plurality of control panels disposed on each of the floors for which the elevator car is intended to service. Each control panel includes inputs for selecting a floor for which the elevator car is to service. The inputs provide a signal to the elevator controller indicating which floor the elevator car is to move between. The elevator controller actuates the elevator motor so as to move the elevator from one floor to the desired floor.

The system further includes a first sensing unit. The first sensing unit is configured to detect a freefalling state of the elevator car. The system includes a second sensing unit configured to detect an unintended movement of the elevator car. The system further includes at least two brakes configured to apply a varied braking force.

A master controller is in communication with each of the brakes. The master controller is in further communication with the first and second sensing units and the elevator controller. The master controller receives information from the elevator controller and is directed to actuate at least one of the brakes so as to apply a braking force configured to stop the elevator at a desired floor.

The first sensing unit communicates to the master controller when a freefalling state is detected and the second sensing unit communicates to the master controller when an unintended movement is detected. The master controller actuates the brakes to apply a braking force configured to prevent a freefall state when a freefalling state is detected and actuates at least one of the brakes to prevent movement of the elevator when unintended movement is detected.

Accordingly, all of the braking function is directed by the master controller. Further, the master controller is configured to selectively actuate any one of the brakes so as to provide a braking force suitable for the desired state, namely the master controller may actuate any one of or multiple combinations of the brakes to provide a braking force which gently stops the elevator car as it moves from one floor to the desired floor or may apply one or a combination of any of the brakes to provide a stoppage of the elevator when a freefall state is detected or unintended movement is detected. Further, it should be appreciated that as the master controller controls all of the brakes, the elevator may continue to operate and provide a desired braking force regardless of the occurrence of a worn brake so long as the remaining brakes are capable of performing either singularly or collectively the desired braking function.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings wherein like structure is indicated with like references and in which:

DETAILED DESCRIPTION OF THE PREFERRED EMBODIMENTS

Figure 1:
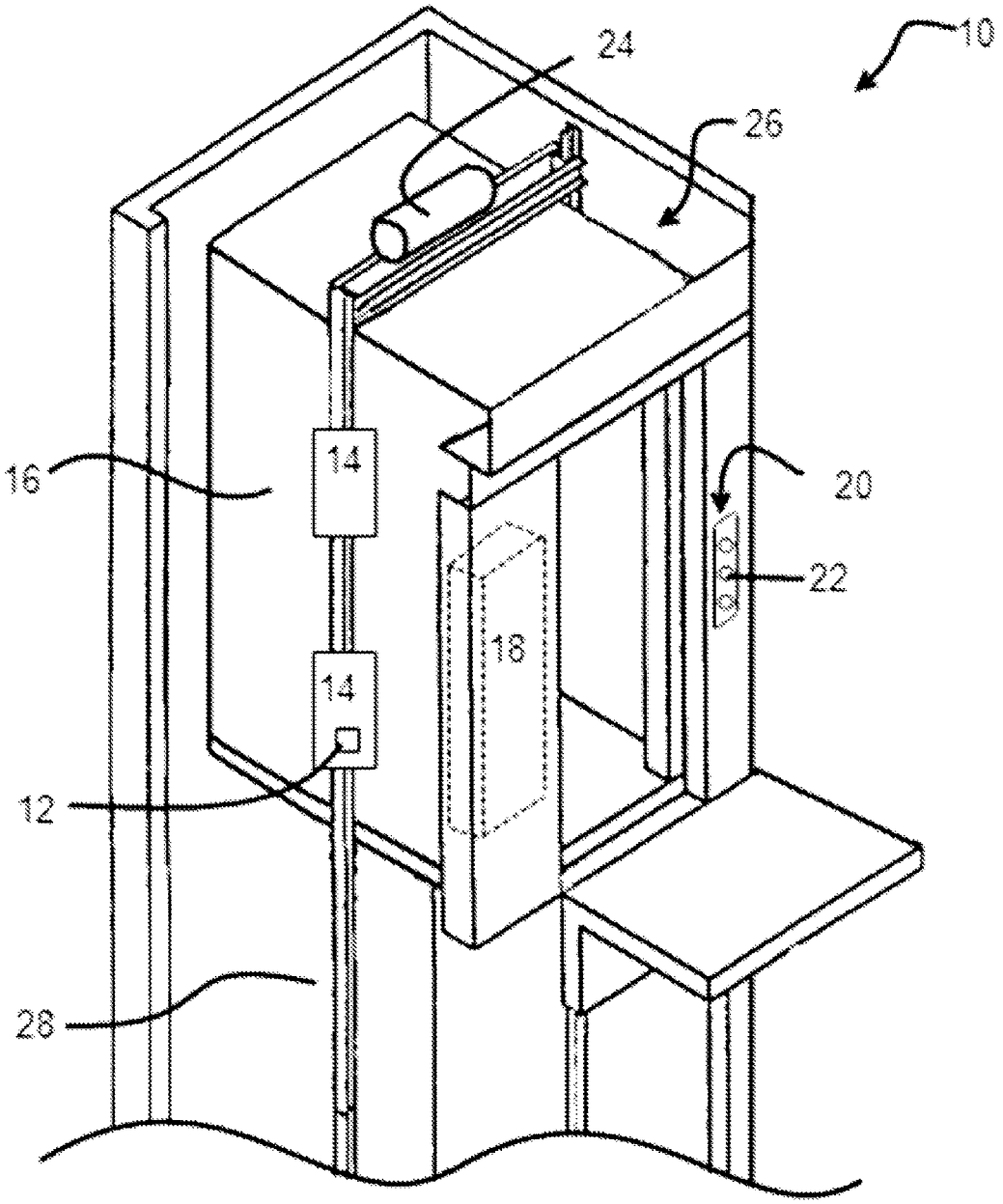
FIG. 1 is a perspective view of a floor showing a control panel having a plurality of buttons.

The embodiments described herein generally relate to an elevator system 10 having a master controller 12. The master controller 12 is configured to control the braking function of the elevator system 10. The elevator system 10 includes a plurality of brakes 14. Each of the brakes 14 are in communication with the master controller 12, wherein the brakes 14 and the master controller 12 share information. In particular, the brakes 14 are configured to provide the master controller 12 with information regarding its physical condition, and operational readiness. The master controller 12 selectively actuates each of the brakes 14 to generate an operational brake force, unintended movement brake force or a freefall brake force, based upon a braking request from an elevator controller and the physical condition and operational readiness of each of the brakes 14.

Accordingly, the elevator system 10 minimizes down time for brake system maintenance as a worn brake 14 may be bypassed and a braking function completed by available brakes 14. Further, the elevator system 10 is configured to selectively actuate any one of the brakes 14 so as to prevent conditions of abrupt stopping and to provide a level elevator car 16 during a stop.

Figure 3:
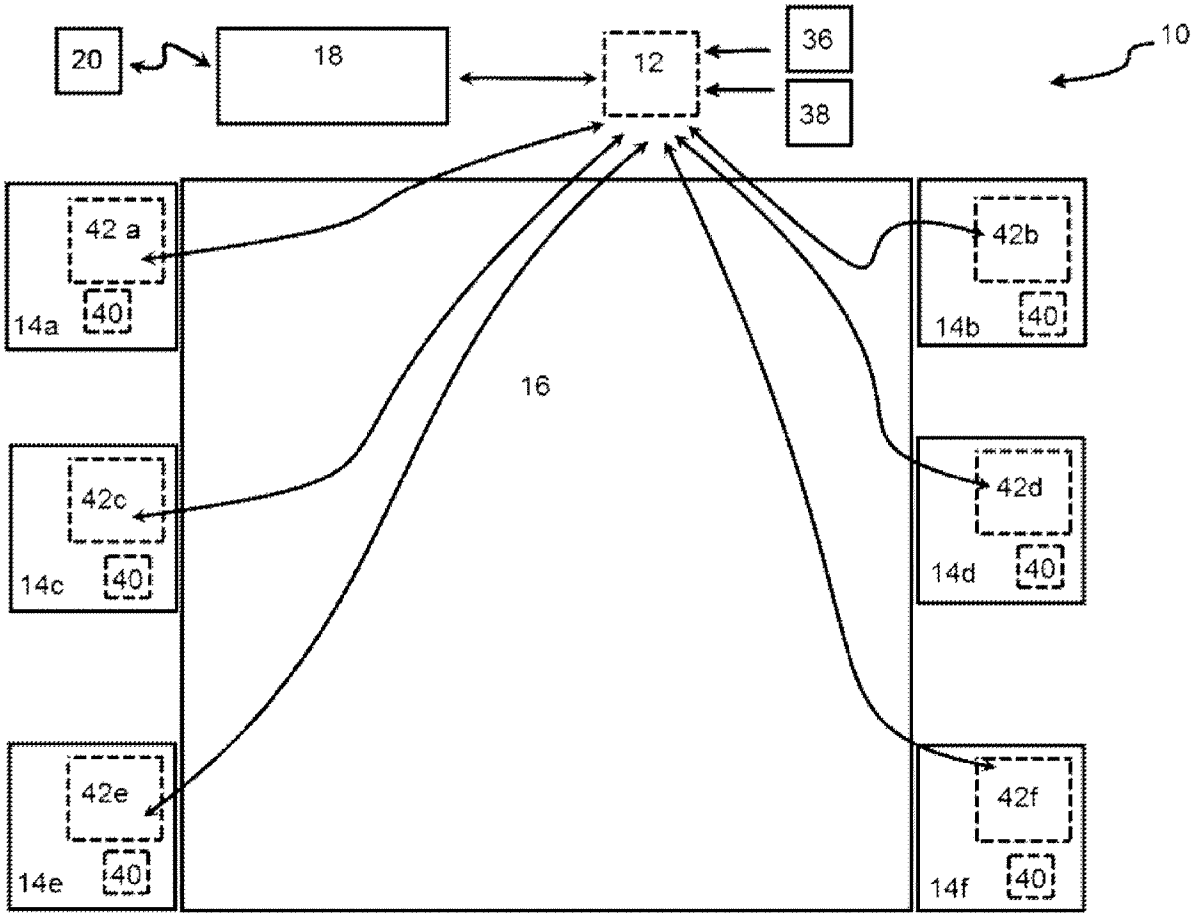
FIG. 3 is a perspective side view of an elevator showing the elevator controller, the rail brakes, the local controllers, and the master controller in communication with each other.

With reference now to FIGS. 1 and 3, an elevator system 10 is provided. The elevator system 10 includes an elevator car 16, and an elevator controller 18. The elevator controller 18 is configured to receive information from the elevator system 10, such information is sent to the master controller 12. The master controller 12 will process such information to calculate a brake profile: operational brake, unintended movement brake, or freefall brake. The calculate brake profile is then transmitted to the elevator controller 18. The elevator controller 18 is in communication with a plurality of control panels 20. Each control panel 20 includes an input 22 configured to provide the elevator system 10 with a signal corresponding to a desired floor the elevator car 16 is to move to. An elevator drive 24 is operatively coupled to or in communication with the elevator car 16. In some embodiments, the elevator drive 24 may engage an elevator cable or belt, a hydraulic jack, or a linear motor which requires no suspension members, to move the elevator car 16 to the selected floor.

In some embodiments, the elevator car 16 is disposed within an elevator shaft 26 and attached to an elevator cable or belt system which the elevator car 16 uses to move between the floors. The elevator shaft 26 is segmented by the building floors, each floor being open to the elevator shaft 26 and floor accessible when the elevator door is opened.

The control panels 20 may be disposed on each of the floors serviced by the elevator system 10. The input 22 may be disposed on the each of the floors serviced by the elevator system 10, within the elevator car 16, or both. The input 22 may include a plurality of buttons each indicating a floor level. However, it should be appreciated that the input 22 shown herein is not limiting and that other inputs 22 currently known and used in the art may be adapted for use herein. For instance, the input 22 may be a touch screen having numbers representing the floors serviced by the elevator system 10, or may be configured to receive voice command.

Figure 2:
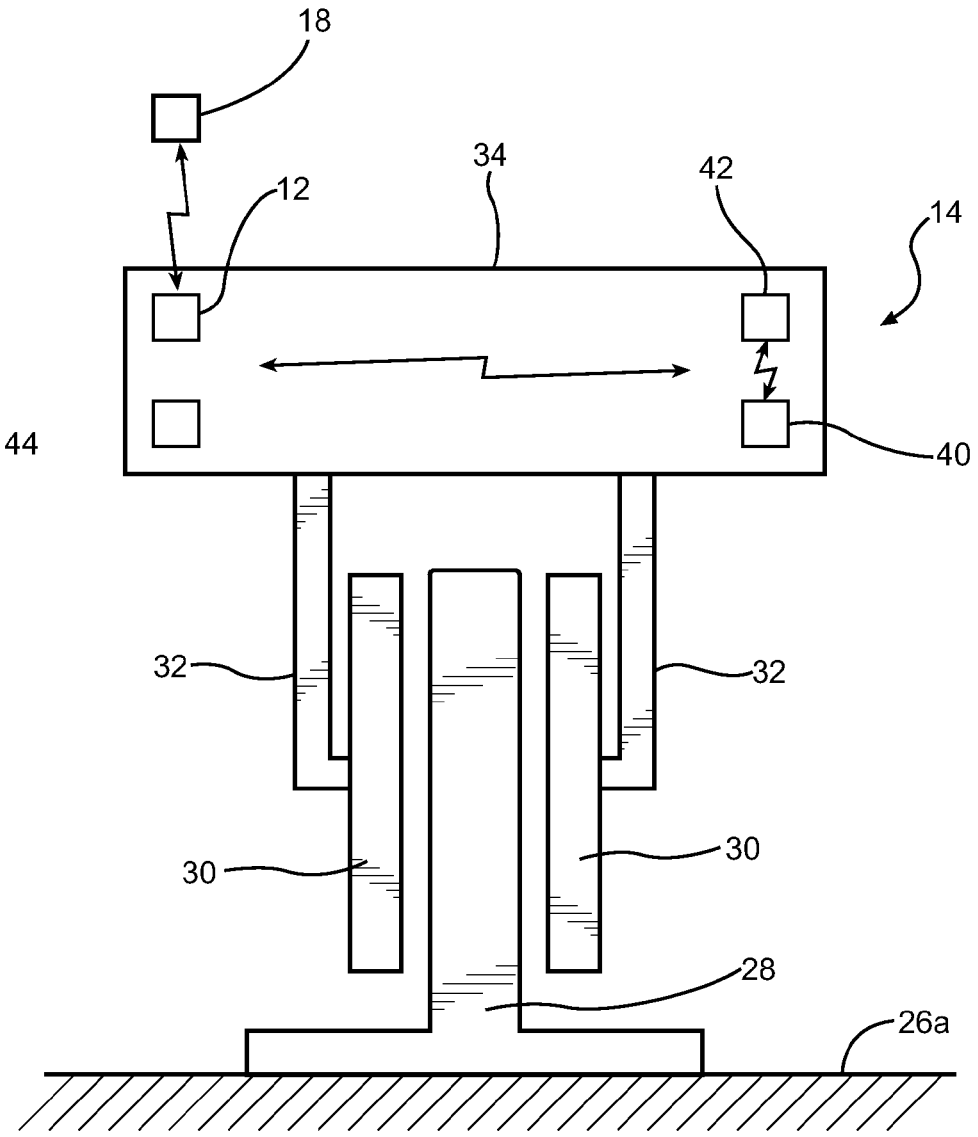
FIG. 2 is a top down view showing a rail brake engaged with a rail.

With reference now to FIG. 2, an illustrative view of the brake 14 is provided. For illustrative purposes, the brake 14 is shown as a rail brake, however it should be appreciated that any brake currently known and used may be adapted for use herein. The rail brake 14 is configured to clamp onto the rail 28. For illustrative purposes, the elevator system 10 includes a pair of rails 28, each disposed on opposing side walls 26*a* of the elevator shaft 26, and extending axially the height of the elevator shaft 26. The rail brakes 14 include a brake pad 30. The brake pads 30 are disposed on arms 32 which are mechanically connected to an actuator 34. The actuator 34 is configured to press the brake pads 30 towards each other so as to pinch the rail 28 there between. The actuator 34 may be a spring configured to bias the arms 32 towards each other, or a hydraulic cylinder, or a mechanical drive. However, it should be appreciated that the actuator 34 may be another mechanism adapted to press the brake pads 30 against the rail 28 such as an electromagnetic drive. The brake pads 30 are formed of a durable and rigid material such as steel and are spaced apart from the respective sides of the rail 28 so as to define a gap.

The elevator system 10 further includes a first sensing unit 36 and a second sensing unit 38. The first sensing unit 36 is configured to detect a freefalling state of the elevator car 16. The first sensing unit 36 may be an accelerometer configured to detect an acceleration of the elevator car 16. The second sensing unit 38 may be a position sensor which detects movement of the elevator car 16, such as a proximity sensor. The first and second sensing units 36, 38 are placed in direct communication with the master controller 12. The master controller 12 will process information from the first and second sensing units 36, 38 to generate a respective freefall brake or unintended movement brake, as needed. The master controller may communicate the status of the first and second sensing units 36, 38 to the elevator controller. It should be appreciated that the examples provided for the first and second sensing units 36, 38 are illustrative and not limiting to the scope of the appended claims, and other instruments/sensors for detecting a freefalling state or unintended movement of the elevator car 16 may be adapted for use herein, illustratively including infrared, optical, radar or laser type motion sensors, encoders, and or laser based position sensors.

The first sensing unit 36 may include an accelerometer configured to detect the acceleration of the elevator. The accelerometer may be configured to provide a signal to the master controller 12 when the acceleration of the elevator car 16 is beyond a predetermined threshold. The master controller 12 may automatically execute a freefall brake when the accelerometer detects an acceleration beyond the predetermined threshold. Accordingly, the master controller 12 selectively actuates one or a combination of the rail brakes 14 to generate a freefall brake The master controller 12 directs the stopping functions of the elevator system 10 so as to ensure that the elevator car 16 stops at the selected floor, stops when the elevator car moves without command from the elevator controller 18, or freefalls. The master controller 12 receives the floor information from the elevator controller 18 and selectively actuates any one of the rail brakes 14 so as to provide an operational brake force for stopping the elevator at the selected floor. The master controller 12 may automatically direct the rail brakes 14 to perform an unintended movement brake or freefall brake when the first and second sensing units 36, 38 directly communicates such a condition to the master controller 12. Accordingly, all braking functions are controlled by the master controller 12.

Each rail brake 14 may further include a third sensing unit 40. The third sensing unit 40 is configured to detect the physical conditions of the rail brakes 14. The third sensing unit 40 may include a plurality of sensors, with each sensor configured to detect a specific physical condition. One sensor, such as an infrared sensor, may be configured to detect the distance of the gap between the outer surface of the pad and the rail 28. Another sensor may be configured to detect the performance of the actuator 34. For instance, when the actuator 34 is a spring, a strain gauge may be used to detect the biasing force of the spring. In instances where the actuator 34 is a hydraulic cylinder, a pressure gauge may be used to detect the force of the cylinder. An optical sensor or an infrared sensor may be used to detect the wear of the pad by measuring the thickness of the pad.

Figure 4:
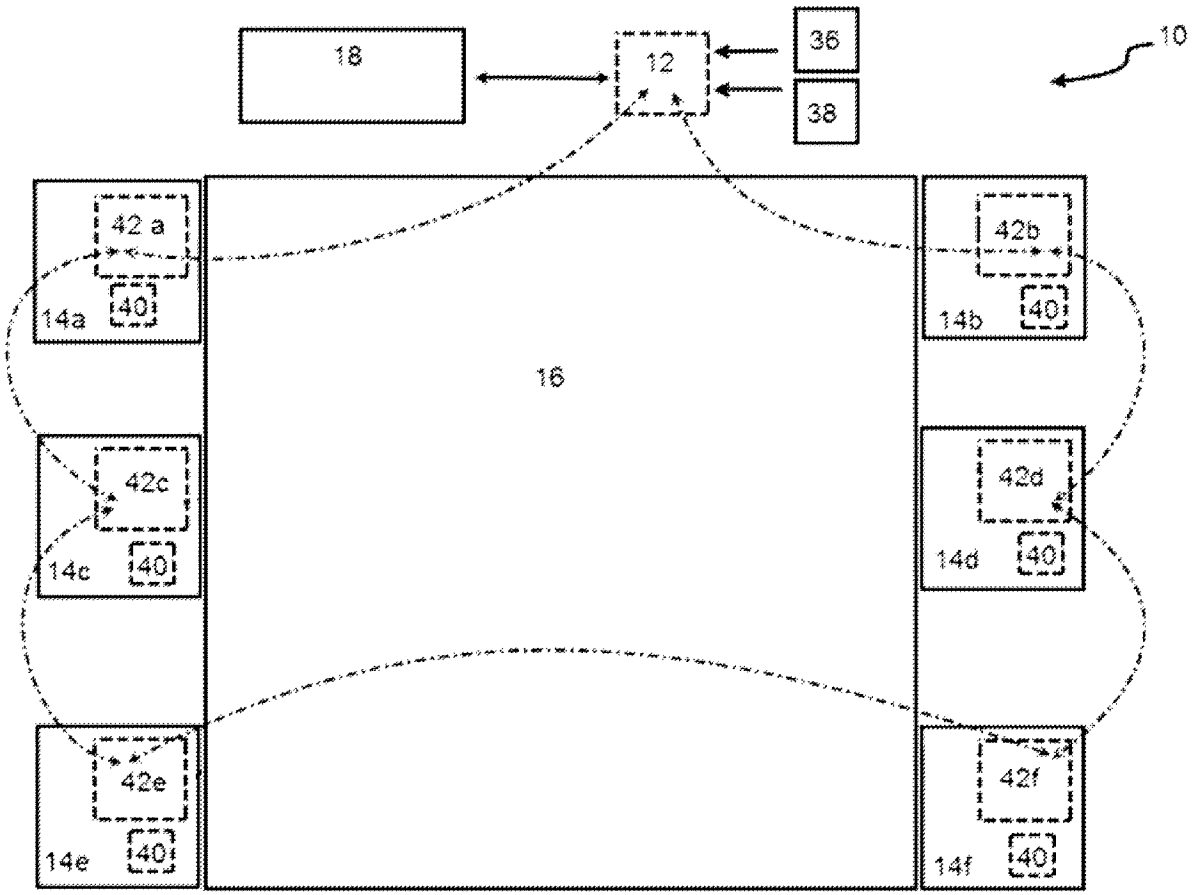
FIG. 4 is a perspective view showing a system where each rail brake has a local brake controller.

With reference now to FIG. 3, the master controller 12 is shown in communication with a local controller 42 in each of the rail brakes 14. However, it should be appreciated that the any local controller 42 can function as the master controller 12 and the rail brakes 14 are configured to communicate with each other, as shown in FIG. 4. Referring again to FIG. 3, the arrows show the master controller 12 is also in communication with the first sensing unit 36, the second sensing unit 38, and a third sensing unit 40 and is also in communication with the elevator controller 18. Accordingly, the master controller 12 may receive information from the elevator controller 18 as to which floor the elevator is directed to, to initiate a braking force or may receive a signal from the first or second sensing unit 36, 38 indicating a respective freefalling state or unintended movement so as to apply a braking force to prevent a freefalling state or unintended movement. It should be appreciated that the braking force for a freefalling state may be different than a braking force for an unintended movement or a braking force used to stop the elevator at a certain floor.

Each rail brake 14 includes a third sensing unit 40. The third sensing unit 40 for a given rail brake is configured to detect the physical conditions of the corresponding rail brake 14. The third sensing unit 40 may include a plurality of sensors, with each sensor configured to detect a specific physical condition. One sensor, such as an infrared sensor, may be configured to detect the distance of the gap between the outer surface of the pad and the rail 28. Another sensor may be configured to detect the performance of the actuator 34. For instance, when the actuator 34 (see FIG. 2) of a braking unit is a spring, a strain gauge may be used to detect the biasing force of the spring. In instances where the actuator 34 is a hydraulic cylinder, a pressure gauge may be used to detect the force of the cylinder. An optical sensor or an infrared sensor may be used to detect the wear of the pad by measuring the thickness of the pad.

The third sensing unit 40 communicates these physical conditions to the local controller 42*a*-42*f* of the corresponding rail brake 14*a*-14*f*. Local controllers 42*b*, 42*c*, 42*d*, 42*e*, 42*f* communicate a status to the master controller 12. When master controller 12 determines a braking force needs to be applied, master controller 12 computes the desired braking profile and sends the braking profile to the desired local controller(s). The local controller(s) actuates its corresponding rail brake to implement the received braking profile. The master controller 12 can create a braking profile so as to accomplish braking based upon the performance ability of each of the rail brakes 14. It should be appreciated that the performance ability of a respective brake may be affected by the physical condition of the brake. For instance, a worn brake pad 30 or actuator 34 may produce a braking force less than that of a new brake pad 30. Further, the gap between the brake pads 30 and the rail 28 may also affect the performance of the rail brake 14. In instances where the gap is beyond a predetermined distance, the rail brake 14 may not produce as much force as a brake pad 30 properly positioned with respect to the rail 28.

By processing the physical condition of the rail brakes 14, the master controller 12 can allocate braking performance throughout the rail brakes 14 to achieve a braking request. Allocation of braking performance among all available rail brakes 14 further allows the elevator system 10 to by-pass a rail brake 14 which may need servicing, or to augment a worn rail brake 14 with the braking force of another rail brake 14. Further, allocation of braking performance among the available brakes allows the master controller 12 to selectively actuate rail brakes 14 to achieve a level and smooth stopping experience. Thus, the master controller 12 can reduce the down time of the elevator for maintenance, and provide a smooth and level stopping experience.

The master controller 12 may receive information to generate a freefall brake which is appropriate for the condition. For instance, the master controller 12 may receive information from the third sensing unit(s) 40 relating to the physical conditions of the respective rail brakes 14, and by-pass a rail brake 14 which has a worn brake pad 30. In some embodiments, the master controller 12 may receive other information from the elevator controller 18 to calculate a freefall brake. For instance, the master controller 12 may receive information from the elevator controller 18 as to which floor the elevator is on. In instances, for example, where the freefall begins at the fortieth floor of a building, the master controller 12 may notify local controllers 42 to actuate the rail brakes 14 so as to dampen the freefalling by selectively actuating any one of the rail brakes 14 so as to ease the elevator car 16 to a stop. Generating a dampened stop helps prevent the occupants within the elevator car 16 from being jarred. Alternatively, in an instance where the freefall begins at the third floor, the master controller 12 may notify local controllers 42 to actuate a braking force configured to stop the elevator car 16 immediately so as to prevent the occupants therein from impacting the ground floor, and thus may not have sufficient time to dampen the freefall.

With reference again to FIG. 3, an illustrative example of the operation of the elevator system 10 is provided. For this illustrative example, assume the elevator system 10 has six rail brakes 14 and the sensing unit determines that rail brake 14*c* has a worn brake pad 30. Further assume that the master controller 12 receives a braking request from the elevator controller 18 to stop the elevator car 16 on the third floor. Further assume that the master controller 12 determines that such a request requires the actuation of four of the six rail brakes 14. The master controller 12 will selectively choose four of the rail brakes 14, not to include the rail brake 14*c* as rail brake 14*c* has a worn brake pad 30. The master controller 12 may further select rail brakes 14*a*, 14*b*, 14*e* and 14*f* with the knowledge that rail brakes 14*a* and 14*b*, and 14*e* and 14*f* are directly opposite each other so as to help provide for a level stop of the elevator car 16.

In another illustrative example, assume the first sensing unit 36 detects a freefall state of the elevator car 16. The master controller 12 receives the detected condition from the first sensing unit 36. The elevator controller 18 may further provide the master controller 12 with the floor at which the freefall state is detected. Further assume that the master controller 12 processes the information from the elevator controller 18 and determines that five rail brakes 14 must be actuated to stop the elevator in a freefall state. Assume also, that rail brake 14*c* has a worn brake pad 30. The master controller 12 may completely bypass actuation of the rail brake 14*c* and notify local controllers 42*a*, 42*b*, 42*d*, 42*e*, and 42*f* to actuate corresponding rail brakes 14*a*, 14*b*, 14*d*, 14*e*, and 14*f*. Alternatively, the master controller 12 may initially notify local controllers 42*a*, 42*b*, 42*d*, 42*e*, and 42*f* to actuate corresponding rail brakes 14*a*, 14*b*, 14*d*, 14*e*, and 14*f*. As the braking demand decreases, the master controller 12 may determine that the brake pad 30 monitored by local controller 14*c* is sufficient to meet the decreased brake demand. In such in instance, the master controller 12 may then notify local controller 14*c* to actuate rail brake 14*c*. Accordingly, the it should be appreciated by those skilled in the art that the master controller 12 continuously receives and processes information from the local controllers 42*a*-42*f* to selectively control their respective rail brakes 14*a*-14*f* to perform the desired braking profile.

With reference now to FIG. 4, the elevator system 10 may include local brake controllers 42*a*-42*f*. The local brake controllers 42*a*-42*f* may be in communication with the corresponding third sensing units 40 for each respective braking unit 14*a*-14*f*. The local brake controllers 42 are each configured to actuate separate respective rail brakes 14*a*-14*f*. Each local brake controller 42 directs the braking function of the respective brake 14. Each local brake controller 42 is in communication with the master controller 12 and receives braking commands from the master controller 12. The local brake controllers 42*a*-42*f* are also in communication with each other.

Each individual rail brake 14 includes a third sensing unit 40 configured to detect the physical condition of the respective rail brake 14. The third sensing unit 40 for each rail brake provides the condition of the rail brake 14 to a respective local brake controller 42. The actuation of the rail brake 14 is coordinated by the master controller 12. The master controller 12, upon receiving a braking request from the elevator controller 18, or the first and second sensing units 36, 38, directs at least one respective local brake controller 42 to actuate a corresponding rail brake 14.

The local brake controller 42 provides braking information to the master controller 12 and the master controller 12 may process the braking information to further direct braking among the local brake controllers 42. Thus, a local brake controller 42 may indicate to the master controller 12 that a respective rail brake 14 is unable to produce a predetermined braking force, and the master controller 12 may process the braking information to direct another local brake controller 42 to actuate a respective rail brake 14 to augment the braking force of the elevator system 10, or may instruct a local brake controller 42 to cease braking and instruct another local brake controller 42 to perform braking.

Braking information and the conditions of each rail brake 14 are shared among the individual local brake controllers 42. However, actuation of a respective rail brake 14 is initiated by the master controller 12. The master controller 12 may be a programmable software unit disposed within each of the local brake controllers 42. Each of the local brake controller 42 may include a master controller 12, with only one of the master controllers 12 activated, wherein said activated master controller 12 directs the braking of all the local brake controllers 42.

The elevator system 10 may further include a check unit 44. The check unit 44 is configured to detect whether or not the master controller 12 can issue a signal. For instance, the check unit 44 may be a programmable software segment configured to detect whether a signal is received from the master controller 12. The check unit 44 is further configured to elect a new master controller 12 in the event that the signal from the master controller 12 is not readable by the respective or any one of the local brake controllers 42. Thus, the elevator system 10 includes flexibility and redundancy so as to ensure that the braking function for the elevator remains with a master controller 12.

Figure 5:
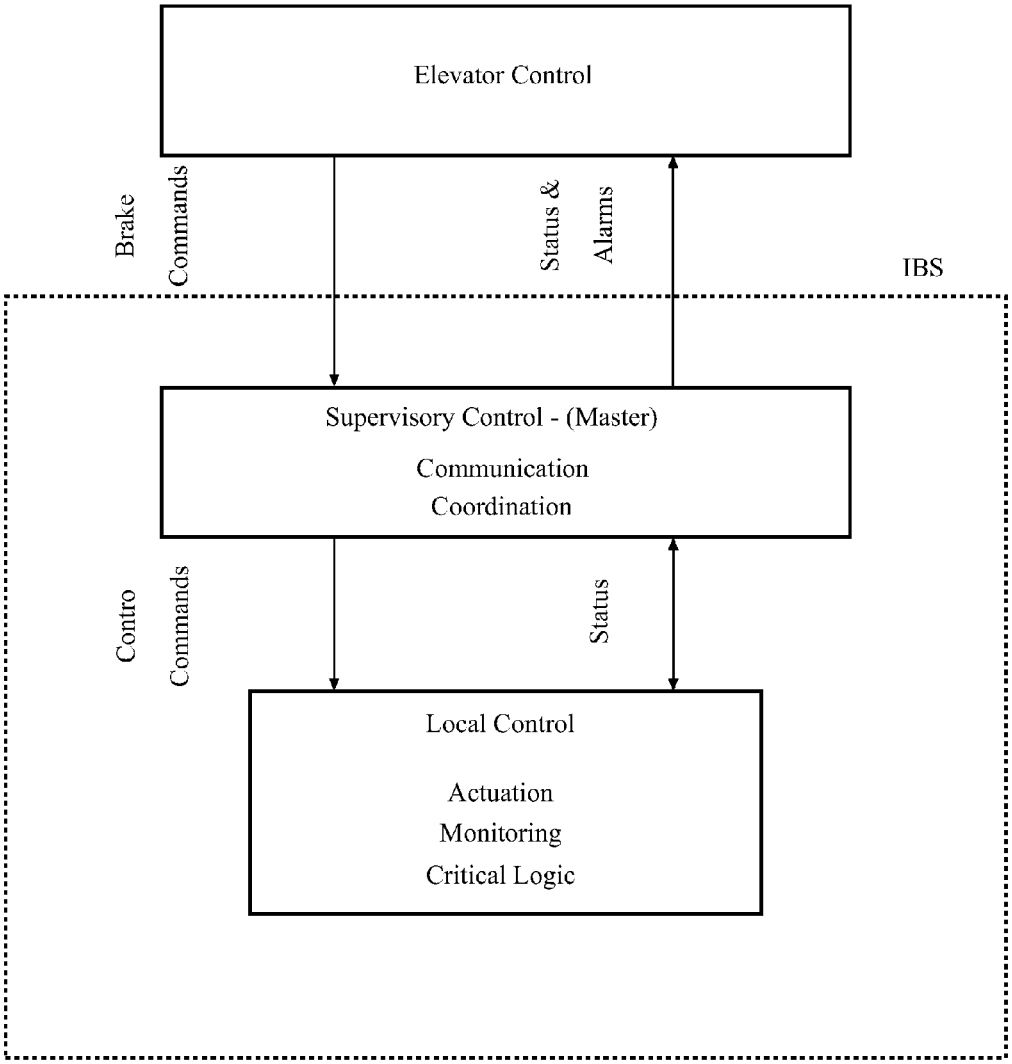
FIG. 5 is a diagram showing the steps of the control function of the elevator controller, master controller and local brake controllers.

With reference now to FIG. 5, the control strategy of the elevator system 10 is provided. The elevator controller 18 is configured to issue a braking command to the master controller 12. The operation of the elevator system 10 is controlled by the elevator controller 18. The elevator controller 18 issues commands to the master controller 12 to generate a braking profile such as operational brake, freefall brake, and/or unintended movement brake. Upon receiving the instructions from the elevator controller 18, the master controller 12 directs the local brake controllers 42 to perform the braking profile.

The master controller 12 directs the local brake controllers 42 based on the status of the individual rail brakes 14, which is determined by the third sensing unit 40, and transmitted from the local brake controller 42 to the master controller 12. The local brake controller 42 may also share the status of the individual rail brakes 14 among each other. The master controller 12 processes the status of the rail brakes 14 and selectively directs the local brake controllers 42 so as to generate the requested braking profile.

The local brake controller 42 controls the actuation of a respective rail brake 14 upon receiving a command from the master controller 12. The local brake controller 42 is also configured to transmit to the master controller 12 the status of the rail brake 14, which the master controller 12 may pass on to the elevator controller 18. Thus, in the event that collectively, the rail brakes 14 are not able to perform any one of the braking profiles, the elevator controller 18 may issue a maintenance notice.

The local brake controller 42 may be further configured to actuate a respective rail brake 14 so as to position the brake pads 30 in a desired position based upon the operation of the elevator car 16. For instance, it may be desirable to increase the gap between the brake pads 30 and the rail 28 when the elevator car 16 reaches a predetermined velocity. Such a function may be beneficial in ensuring that the brake pads 30 do not inadvertently touch the rail 28 during high speeds. At lower speeds, it may be desirable to decrease the gap to help provide a smooth operation of the rail brake 14 and decrease the time required for the brake pads 30 to engage the rail 28. The local brake controllers 42 may be programmed with critical parameters for the condition of a respective rail brake 14. As used herein, "critical parameter" refers to a condition of the rail brake 14 which may prevent the rail brake 14 from performing a braking function, or for which the rail brake 14 must be serviced. Such a condition may include the wear of the brake pad 30, or the effectiveness of the actuator 34.

The master controller 12 may be further configured to initiate a majority voting scheme among the local brake controllers 42. The majority voting scheme is a process used to designate a master controller and switch to a new master controller if the current designated master controller is not functioning properly. The majority voting scheme requires each of the local brake controllers 42 to determine if it can serve as a master controller 12, in that the local controller 42 can receive information from and send commands to the other local controllers 42. Each local controller 42 that can perform master controller 12 functions is then identified as being eligible and any one of the eligible local controllers may be designated a master controller 12 in the event the current master controller 12 is not functioning properly. The majority voting scheme may also issue a maintenance call when a threshold number of the local controllers 42 or rail brakes 14 cannot operate within the predetermined manner.

With reference again to FIG. 4, the operation of the elevator system 10 having a local controller 42 is provided. For illustrative purposes, the elevator system 10 is shown having six rail brakes 14*a*-14*f*, three are operatively mounted to a first rail 28 and the other three rail brakes 14 are mounted to a second rail 28. The rail brakes 14*a*-14*f* are generally disposed opposite each other and symmetrical in orientation, meaning that the three rail brakes 14*a*, 14*c*, 14*e* on one side of the elevator car 16 are each respectively axially aligned with a corresponding rail brake 14*b*, 14*d*, 14*f* on the other side of the elevator car 16. The rail brakes 14*a*-14*f* are spaced apart and stacked axially on top of each other.

The rail brakes 14*a*-14*f* each include a separate local brake controller 42*a*-42*f* which controls the actuation of the respective rail brakes 14*a*-14*f*. Each rail brake 14 further includes a third sensing unit 40 configured to detect the condition of the respective rail brake 14. For illustrative purposes, referring briefly back to FIG. 2, the actuator 34 is shown as a hydraulic cylinder configured to actuate a piston. The piston is mechanically connected to a respective brake pad 30 to urge the brake pad 30 into engagement with a respective rail 28.

The third sensing unit 40 includes a hydraulic pressure sensor, and a linear sensor on the hydraulic piston. Thus, the third sensing unit 40 may be configured to detect the air gap, and performance of the rail brake 14. Such information is fed to the local brake controller 42 so as to accurately control the braking force and air gap.

The user actuates the input 22 (e.g. makes a selection on an elevator control panel, or other control device, etc.) to select a floor, waits for the elevator door to open, enters the elevator car 16, and the elevator controller 18 closes the elevator door and actuates the elevator drive 24 so as to move the elevator car 16 to the desired floor. In such a scenario, the elevator controller 18 commands the master controller 12 to perform an operational brake, and may further provide the master controller 12 with information relating to the speed of the elevator car 16, the selected floor, and the floor from which the elevator car 16 departed.

The master controller 12 processes the information to generate an operational braking profile. The master controller 12 processes information from the local brake controllers 42 to determine which of the rail brakes 14 are available to perform the task. Such information may include, the wear of the brake pads 30, the gap between the brake pads 30 and the rail 28 and the pressure of the hydraulic cylinder. Upon processing the request from the elevator controller 18 and local brake controllers 42, the master controller 12 selectively commands the local brake controller 42 to perform the generated operational braking profile.

It should be appreciated that the scenario provided is for illustrative purposes and is not limiting. For instance, the master controller 12 may generate an unintended movement braking profile, or a freefall braking profile upon command from the elevator controller 18. In such an event, the master controller 12 also processes information from the elevator controller 18 and the local brake controllers 42 to generate an unintended movement braking profile or a freefall braking profile, as the case may be.

Figure 6:
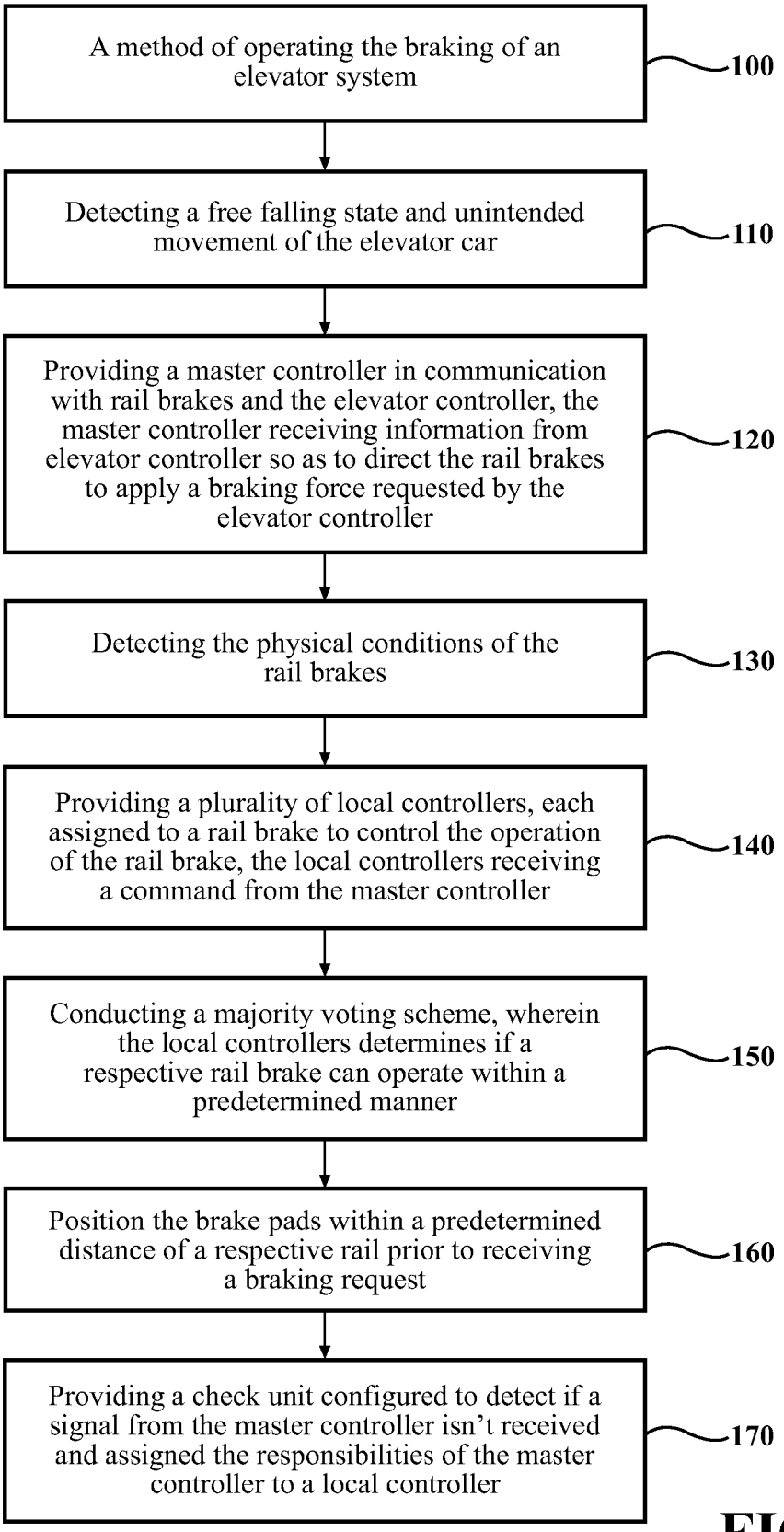
FIG. 6 is a diagram showing the method for controlling the braking of an elevator system.

With reference now to FIG. 6, a method 100 for operating the braking of an elevator system 10 is provided. The elevator system 10 includes at least two rail brakes 14. Each of the rail brakes 14 is configured to engage a rail 28 so as to stop an elevator car 16. The elevator controller 18 is configured to issue a braking request. The braking request may be based upon a movement of the elevator car 16 from one floor to another, an unintended movement of the elevator car 16, or a freefalling elevator car 16.

The method proceeds to step 110 wherein a free falling state and an unintended movement of the elevator car 16 is detected. The method proceeds to step 120 wherein a master controller 12 is in communication with each of the rail brakes 14 and the elevator controller 18. The master controller 12 receives a braking request from the elevator controller 18, as well as a braking request wherein the master controller 12 process the information along with the braking request so as to direct at least one of the two rail brakes 14 to apply a braking force to satisfy the braking request. The braking request may be to stop the elevator car 16 at a desired floor, or when unintended movement or a freefalling state is detected.

The method may further include step 130 wherein the physical conditions of the rail brakes 14 are detected, and processed to calculate a stopping force. The physical conditions may include a gap between a brake pad 30 of the rail brakes 14 and a rail 28, the thickness of the brake pad 30 and the force of an actuator of the at least two rail brakes 14. Such information may be processed by the master controller 12 to determine which of the available rail brakes 14, either singularly or collectively can generate the braking request. For instance, the master controller 12 may only direct two of three rail brakes 14 to perform an operational brake when it is known that the third rail brake 14 is not performing properly.

The method may further including step 140, providing a plurality of local brake controllers 42. The number of local brake controllers 42 is the same as the number of rail brakes 14, such that the operation of each rail brake 14 is controlled by a local brake controller 42. The local brake controllers 42 transmit the physical conditions of the respective brake pad 30 to the master controller 12. The master controller 12 processes the physical conditions of the brake pads 30, and the braking request so as to selectively instruct one or a combination of the local brake controllers 42 to perform a braking function, such that either singularly or collectively, the local braking controllers generate the braking request.

The method may proceed to step 150, wherein the local brake controllers 42 are configured to perform a majority voting scheme. The majority voting scheme is a process wherein each of the local brake controllers 42 determines if a respective rail brake 14 can operate within a predetermined manner, wherein a maintenance call is issued when the majority of the rail brakes 14 cannot operate within the predetermined manner.

The method may proceed to step 160, wherein the local brake controllers 42 position the brake pads 30 a predetermined distance from the respective rail 28 prior to receiving a braking request. This step may be useful in ensuring that the elevator car 16 moves smoothly, and does not come to an abrupt start. For instance, it may be desirable to increase the gap between the brake pads 30 and the rail 28 when the elevator car 16 reaches a predetermined velocity. Such a function may be beneficial in ensuring that the brake pads 30 do not inadvertently touch the rail 28 during high speeds. At lower speeds, it may be desirable to decrease the gap to help provide a smooth operation of the rail brake 14 and decrease the time required for the brake pads 30 to engage the rail 28.

One of the local brake controllers 42 also assumes the master controller function, and the method may proceed to step 170 wherein a check unit 44 is provided. The check unit 44 is configured to detect whether or not the master controller 12 can issue a signal. For instance, the check unit 44 may be a programmable software segment configured to detect whether a signal is received from the master controller 12. The check unit 44 is further configured to elect a new master controller 12 in the event that the signal from the master controller 12 is not readable by the respective or any one of the local brake controllers 42.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

The invention claimed is:

1. A system for controlling the movement and braking of an elevator car in a shaft of an elevator system, comprising:

at least two brake units each having a separate local controller associated therewith, said brake units being operatively coupled to the elevator car and configured to be controlled by said local controllers to selectively apply a varied braking force to resist movement of the elevator car;

an elevator controller configured to receive user input signals from a user control panel and generate signals corresponding to requests to initiate associated movement and braking functions for the elevator car, based on the user input; and a master controller in communication with each of the elevator controller and the at least two local controllers for each of the at least two brake units, the master controller being configured to, receive from the elevator controller a request to perform a specified braking function, determine an appropriate braking force profile for the elevator car based on the requested braking function, and instruct at least one of said local controllers to actuate at least one of said brake units to generate appropriate braking forces so as to substantially achieve the generated braking profile for the elevator car.

2. The system as set forth in claim 1, further comprising:

at least a first sensing unit in communication with said master controller and configured to detect a free falling state of the elevator car and transmit such detected information to said master controller;

at least a second sensing unit in communication with said master controller and configured to detect an unintended movement of the elevator car and transmit such detected information to said master controller; and at least one third sensing unit in communication with each of said local brake units and configured to detect the physical conditions of at least one of the at least two brakes and transmit such detected information to said master controller.

3. The system as set forth in claim 2, wherein the at least two brakes are rail brakes.

4. The system as set forth in claim 3, wherein the third sensing unit is configured to detect the wear of a brake pad of each of the at least two brakes.

5. The system as set forth in claim 3, wherein the each of the at least two rail brakes includes an actuator, and wherein the third sensing unit is configured to detect the force of each of the actuators of the at least two rail brakes.

6. The system as set forth in claim 3, wherein the third sensing unit is configured to detect the gap between a brake pad and a corresponding rail.

7. The system as set forth in claim 1, wherein the master controller is disposed on one of the at least two brakes.

8. The system as set forth in claim 2, wherein the master controller is disposed on one of the at least two brakes.

9. The system as set forth in claim 2, further including a plurality of local brake controllers, the plurality of local brake controllers disposed on a respective one of the plurality of rail brakes and configured to actuate the respective brake, the plurality of local brake controllers in communication with the third sensing unit and configured to actuate the respective one of the plurality of brakes.

10. The system as set forth in claim 9, wherein the third sensing unit is configured to detect the wear of each of the at least two brakes.

11. The system as set forth in claim 9, wherein the each of the at least two brakes includes an actuator, and wherein the third sensing unit is configured to detect the force of each of the actuators of the at least two brakes.

12. The system as set forth in claim 9, at least two brakes are rail brakes and wherein the third sensing unit is configured to detect the gap between a brake pad and a corresponding rail.

13. The system as set forth in claim 9, further including a check unit, configured to detect if a transmission from the master controller is received by any one of the plurality of local brake controllers.

14. The system as set forth in claim 13, wherein one of the plurality of local brake controllers is the master controller, and wherein the check unit elects a different local brake controller as the master controller when a transmission from the master controller is not received by any one of the local brake controllers.

15. A method for operating the braking of an elevator system, the elevator system having a system according to claim 1, the method comprising:

detecting by at least one sensor in communication with the elevator car, at least one of a free falling state or an unintended movement of the elevator car; and in the master controller, receiving, at least one of information from the elevator controller so as to direct at least one of the two brakes to apply a braking force to stop the elevator car at a desired floor, or information from the at least one sensor so as to direct at least one of the two brakes to apply a braking force to stop the elevator car when one of an unintended movement or a freefalling state is detected.

16. The method as set forth in claim 14, further including the step of detecting the physical conditions of the at least two rail brakes, and processing the physical conditions of the at least two rail brakes to calculate a stopping force.

17. The method as set forth in claim 15, wherein the at least two brakes are rail brakes, the rail brakes having a brake pad and an actuator, the actuator configured to press the rail brakes against a rail, wherein the physical conditions include a gap between the brake pad and the rail, the thickness of the brake pad and the force of the actuator of the at least two rail brakes.

18. The method as set forth in claim 17, further including the step of providing a plurality of local brake controllers, the plurality of local brake controllers disposed on a respective one of the at least two rail brakes and configured to actuate the respective rail brake, the plurality of local brake controllers transmitting the physical conditions of the respective brake pad to the master controller, the master controller processing both the physical conditions of the brake pads and the braking request so as to selectively instruct at least one of the local brake controllers to perform a braking function, wherein collectively, the local braking controllers generate the braking request.

19. The method as set forth in claim 18, further including the step of performing a voting scheme, wherein a determination is made as to whether each of the plurality of local brake controllers may perform the functions of the master controller, and wherein anyone of the plurality of local brakes able to perform the functions of the master controller is designated the master controller when the current master controller is unable to perform.

20. The method as set forth in claim 18, further including the step of locating the master controller with one of the plurality of local brake controllers and providing a check unit, wherein the check unit is configured to determine if a signal from the master controller is received by any of the local brake controllers, and wherein the check unit designates a new master controller when any one of the local brake controllers fails to receive a signal from the master controller.

* * * * *